US006697302B1

(12) United States Patent
Cray et al.

(10) Patent No.: US 6,697,302 B1
(45) Date of Patent: Feb. 24, 2004

(54) HIGHLY DIRECTIVE UNDERWATER ACOUSTIC RECEIVER

(75) Inventors: Benjamin A. Cray, West Kingston, RI (US); Victor F. Evora, Narragansett, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/406,160

(22) Filed: Apr. 1, 2003

(51) Int. Cl.[7] ..... H04R 1/02
(52) U.S. Cl. ..... 367/141; 367/176; 367/188
(58) Field of Search ..... 367/141, 152, 367/162, 165, 167, 172, 173, 176, 178, 182, 185, 188; 310/340, 344, 337; 181/122; 73/649

(56) References Cited

U.S. PATENT DOCUMENTS 6,370,084 B1 * 4/2002 Cray ..... 367/141

* cited by examiner

*Primary Examiner*—Daniel T. Pihulic
(74) *Attorney, Agent, or Firm*—James M. Kasischke; Michael F. Oglo; Jean-Paul A. Nasser

(57) ABSTRACT

An underwater acoustic receiver sensor is disclosed that measure up to seven (7) quantities of acoustic field at a collocated point. The quantities measured by the acoustic receiver sensor are acoustic pressure, three orthogonal components of acoustic particle acceleration and three spatial gradients of the acceleration vector. These quantities are appropriately combined and provides for improved directivity of the acoustic receiver sensor.

11 Claims, 1 Drawing Sheet

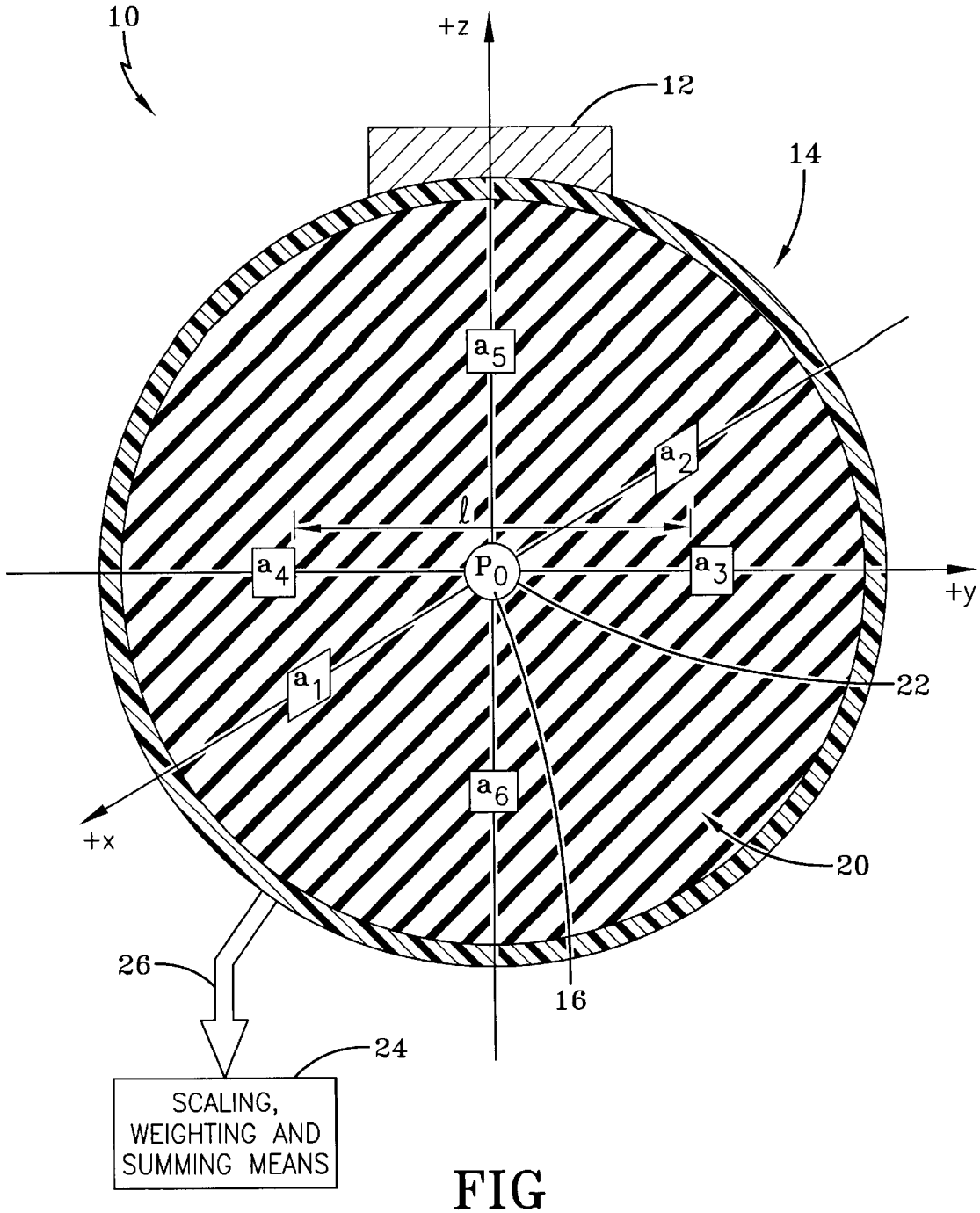
FIG

HIGHLY DIRECTIVE UNDERWATER ACOUSTIC RECEIVER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to underwater acoustic receiving sensors and, more specifically, to an underwater acoustic receiving sensor that measures the pressure, acoustic particle velocity, and the three gradients of acoustic particle velocity in such a manner as to improve the directivity of the underwater acoustic receiving sensor.

(2) Description of the Prior Art

Pressure sensors, or hydrophones, are commonly used to detect sound underwater. These sensors are omni-directional and can not distinguish the arrival direction of a sound source. Pressure sensors are often configured into an array of sensors, and the array then provides a means to estimate the source location. Better angular resolution is obtained by larger arrays of pressure sensors.

In the early 1990's, new types of underwater acoustic receiving sensors were considered for sonar applications. Conventional underwater acoustic sensors measure acoustic pressure and are omni-directional. That means, the response of the traditional sensor is uniform in all directions. It is desired to have a non-uniform, or directional sensor, that can look in a given direction and reject noise arriving at other angular directions. Improvements have been made to acoustic receiving sensors. For example, the Conformal Acoustic Velocity System (CAVES) uses a sensor that measures a single component of acoustic particle velocity.

U.S. Pat. No. 6,370,084 discloses a device that measures pressure and three components of acoustic particle velocity at a collocated point; however, this device cannot measure pressure or gradients of acoustic particle velocity. It is desired that further improvements be provided for underwater acoustic sensors especially to improve their directivity.

SUMMARY OF THE INVENTION

Therefore, it is an object of the present invention to provide an underwater acoustic sensor having improved directivity in that it senses parameters, in the form of desired signals, received from selected directions and rejects noise arriving at other angular directions.

It is another object of the present invention to provide an underwater acoustic receiver sensor that measures seven quantities of an acoustic field at a collocated point. It is an additional object to measure acoustic pressure, three orthogonal components of acoustic particle acceleration, and three spatial gradients of the acceleration vector.

It is still another object of the present invention to provide an acoustic receiver having a directivity index of about 9.5 dB.

The underwater acoustic receiver sensor of the present invention measures pressure $P_0$, three components of acoustic particle velocity (u,v,w), and three gradients of acoustic particle velocity $$\frac{\partial u}{\partial x}, \frac{\partial v}{\partial y}, \frac{\partial w}{\partial z}$$

all at a collocated point $\bar{r}_o$ in space. The underwater acoustic receiver sensor is capable of being mounted and comprises an enclosed housing having a center, x, y, and z axes, an interior of the housing filled with a polymer, and a pressure sensor rigidly attached at the center of the housing. The underwater acoustic receiver further comprises three pairs of collinear accelerometers $a_1$–$a_2$; $a_3$–$a_4$; and $a_5$–$a_6$ respectively arranged and attached along the x, y and z axes, respectively, within the housing and with each pair being oppositely positioned relative to the center of the enclosure and separated from each other by a predetermined distance l.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIGURE is the sole drawing that is a substantially sectional view and illustrates one form of the acoustic receiver sensor of the present invention.

DESCRIPTION OF THE PREFERRED EMBODIMENTS

In general, the underwater acoustic receiver of the present invention is a device that measures up to seven quantities of an acoustic field at a collocated point. The quantities measured by the receiver are acoustic pressure, the three orthogonal components of acoustic particle acceleration, and three spatial gradients of the acceleration vector. When these quantities are appropriately combined, by means of the present invention, a highly directional acoustic response is generated. The underwater acoustic receiver of the present invention is illustrated in the FIGURE.

The underwater acoustic receiver sensor 10 measures pressure $P_0$, three components of acoustic particle velocity (u,v,w), and three gradients of acoustic particle velocity $$\frac{\partial u}{\partial x}, \frac{\partial v}{\partial y}, \frac{\partial w}{\partial z}$$

all at a collocated point $\bar{r}_o$ in space. The underwater acoustic receiver sensor has provisions (not shown) for being connected to a mount 12.

The underwater acoustic receiver 10 comprises an enclosed housing 14 having a center 16, x, y, and z axes. An interior of housing 14 is filled with a polymer 20. The housing 14 is preferably comprised of hard plastic and the polymer 20 is preferably polyurethane; however, this can be any resilient material having an acoustic impedance similar to water.

The underwater acoustic receiver further comprises a pressure sensor 22 at the center 16 of the housing 14. The pressure sensor 22 provides an output signal $P_0$ and may be a conventional piezoelectric ceramic hydrophone.

The underwater acoustic receiver further comprises three pairs of collinear accelerometers $a_1$–$a_2$; $a_3$–$a_4$; and $a_5$–$a_6$ respectively arranged along the x, y and z axes within housing 14. Accelerometers $a_1$–$a_2$, $a_3$–$a_4$ and $a_5$–$a_6$ are embedded in polymer 20 in a manner that allows the accelerometers to move with acoustic motion. Each pair of accelerometers is oppositely positioned relative to the center 16 of the enclosure, and separated from each other by a predetermined distance l. Each of the accelerometers $a_1$–$a_2$, $a_3$–$a_4$ and $a_5$–$a_6$ has an operating wavelength A which is greater than the distance l. The operating wavelength $\lambda$ corresponds to a frequency range from about 100 Hz to about 2000 Hz. Each of the accelerometers $a_1$, $a_2$, $a_3$, $a_4$, $a_5$, and $a_6$ may be neutrally buoyant and are conventional devices known in the art. Each of the accelerometers $a_1$, $a_2$, $a_3$, $a_4$, $a_5$, and $a_6$ provides an output signal respectively termed, $a_1$, $a_2$, $a_3$, $a_4$, $a_5$, and $a_6$.

The polymer 20 is acoustically transparent and isolates the accelerometers $a_1$–$a_2$; $a_3$–$a_4$; and $a_5$–$a_6$ from the mount 12 and insulates the accelerometers $a_1$–$a_2$; $a_3$–$a_4$; and $a_5$–$a_6$ from structure-borne flexural vibrations from supporting structure near the underwater acoustic receiver 10. The underwater acoustic receiver 10 can thus be mounted on shipboard structure with a minimum of self-noise due to nearby rigid structures and without loss of signal sensitivity.

Alternatively, the device can be floated at a level beneath the surface of a water body, inasmuch as the underwater acoustic receiver 10 is of neutral buoyancy.

The directive response of the underwater acoustic receiver may be shown mathematically using a second order Taylor series expansion of acoustic pressure about the origin of a Cartesian coordinate system. The second-order Taylor series expansion of an acoustic pressure field can be expressed as:

$$P(\bar{r}) \cong \tag{1}$$

$$P(\bar{r}_o) + \rho_o i[\bar{r}_o - r]\begin{bmatrix} u \\ v \\ w \end{bmatrix} + \frac{1}{2}\rho_o i\omega[\bar{r}_o - \bar{r}]\begin{bmatrix} \frac{\partial u}{\partial x} & \frac{\partial u}{\partial y} & \frac{\partial u}{\partial z} \\ \frac{\partial u}{\partial y} & \frac{\partial v}{\partial y} & \frac{\partial v}{\partial z} \\ \frac{\partial u}{\partial z} & \frac{\partial v}{\partial z} & \frac{\partial w}{\partial z} \end{bmatrix}^T [\bar{r} - \bar{r}_o] ,$$

where $\rho_o$ is the ambient density of the surrounding fluid, $\omega$ is the radian frequency of the acoustic wave u, v, and w are the components of the velocity vector and i is the square root of −1. The position vector is $\bar{r}_o$ and T indicates the transpose of velocity gradient matrix.

The zeroth order term of the power series expansion of expression (1) is proportional to pressure, the first order to acoustic particle velocity, and the second order proportional to the gradient of velocity. An acoustic vector sensor is a device that measures pressure (P) and all three components of acoustic particle velocity (u, v, w) at a collocated point ($\bar{r}_o$) and one of which is disclosed in U.S. Pat. No. 6,370,084 ('084). Unlike the '084 Patent, the present invention provides a highly directive underwater acoustic receiver 10 that measures a total of seven independent acoustic quantities at a collocated point in space. That is, in addition to measuring particle velocity (u,v,w), as in a vector sensor, the highly directive underwater acoustic receiver 10 also measures the three gradients of acoustic particle velocity $$\frac{\partial u}{\partial x}, \frac{\partial v}{\partial y}, \frac{\partial w}{\partial z}.$$

These components are proportional to the instantaneous density of the acoustic field.

The present invention provides means so that all seven of these quantities may be appropriately scaled, weighted, and summed. More particularly, as seen in FIGURE the present invention provides means 24, known in the art, for scaling, weighing, and summing the signals $P_0$, $a_1$, $a_2$, $a_3$, $a_4$, $a_5$, and $a_6$ that are routed (connections not shown for the sake of clarity, but known in the art) to means 24 by way of signal path 26. The power sum $B^7$ of the weighted quantities can be written as:

$$B^7(\theta, \phi) = |w_p + w_x a + w_y b + w_z c + w'_x a^2 + w'_y b^2 + w'_z c^2|^2 \tag{2}$$

where $\theta$, $\phi$ are the azimuth and elevation-acoustic planewave arrival angles and the directional responses are: $a=\cos(\theta)\sin(\phi)$, $b=\sin(\theta)\sin(\phi)$, and $c=\cos(\phi)$. The arbitrary weights are $W_p$, $W_z$, $w_y$, $w_z$, $w'_x$, $w'_y$, and $w'_z$. The maximum directivity of the highly directive acoustic receiver can be determined by substituting equation (2) into the expression that defines an array's Directivity Index in a manner known in the art. The Directivity Index can be defined in a manner known in the art, such as that disclosed in U.S. Pat. No. 6,172,940 ('940), herein incorporated by reference. Using the principles of the '940 Patent, it may be shown that highly directive acoustic receiver 10 of the present invention has a Directivity Index of 9.5 dB. This compares to a Directivity Index of 4.8 dB for the acoustic vector sensor disclosed in the previously mentioned '084 Patent. A single pressure sensor of the prior art is omnidirectional and has no directivity 10, whereas the underwater acoustic receiver 10 has a Directivity Index of about 9.5 dB, used to measure a point in space, and is equivalent to a 9-element line array of pressure sensors with half-wavelength separations between elements. Hence, at a frequency of 1000 Hz, for example, an array of pressure sensors would need to have a length of 22 feet to obtain the same directivity as the single highly directive underwater acoustic receiver 10 of the present invention.

In operation, and with reference to the FIGURE, the underwater acoustic receiver 10 measures pressure ($P_0$). Acoustic particle acceleration being sensed by each of the accelerometers $a_1$–$a_6$ (which can be easily converted to acoustic velocity by taking the time derivative) is obtained by taking the average of the acceleration along a given axis. For example, the x-acceleration component (denoted u in terms of velocity) is obtained by summing accelerometer outputs $a_1$ and $a_2$ and dividing by two. The acceleration components $a_y$ and $a_z$ (denoted v and w in velocity) are obtained in a similar manner. To prevent phase errors, the separation distance, l, between collinear accelerometers $a_1$–$a_6$ should be less than a wavelength, $l \ll \lambda$, of the frequency of interest. The measured pressure, acceleration (time derivative of velocity), and acceleration gradient (time derivative of velocity gradient) may be expressed as follows:

$$\text{Pressure: } P_0 \tag{3}$$

$$\text{Acceleration: } a_x = \frac{a_1 + a_2}{2}, a_y = \frac{a_3 + a_4}{2}, a_z = \frac{a_5 + a_6}{2} \tag{4}$$

$$\text{Acceleration Gradient: } \frac{\partial a_x}{\partial x} \cong \frac{a_1 - a_2}{l}, \tag{5}$$

$$\frac{\partial a_y}{\partial y} \cong \frac{a_3 - a_4}{l}, \frac{\partial a_z}{\partial z} = \frac{a_5 - a_6}{l}$$

The spatial gradient of acceleration is approximated by taking finite differences of the acceleration components. For example, the acceleration gradient along the x-axis is $$\frac{\Delta a_x}{\Delta_x} = \frac{a_2 - a_1}{l}.$$

The u-velocity gradient, $$\frac{\partial u}{\partial x},$$

is obtained by taking the time derivative of the acceleration gradient which, for harmonic planewaves, is equivalent to dividing the acceleration by a constant and multiplying by angular frequency. Likewise, the spatial gradients $$\frac{\partial v}{\partial y} \text{ and } \frac{\partial w}{\partial z}$$

are obtained in a manner given for the u-velocity gradient. Thus, with six neutrally buoyant accelerometers $a_1$, $a_2$, $a_3$, $a_4$, $a_5$, and $a_6$ and one pressure sensor $P_0$, the acoustic quantities $P_0$, u, v, w, u', v', and w' are measured and utilized by the present invention to provide an underwater acoustic receiver 10 having a Directivity Index of about 9.5 dB.

It should now be appreciated that the underwater acoustic receiver sensor of the present invention has improved directivity.

It will be understood that various changes and details, steps and arrangement of parts and method steps, which have been described and illustrated in order to explain the nature of the invention, may be made by those skilled in the art within the principle and scope of the invention as expressed in the appending claims.

What is claimed is:

1. An underwater acoustic receiver sensor comprising:

an enclosed housing defining an interior having a center, x, y, and z axes:

a resilient material positioned in said enclosed housing interior;

a pressure sensor positioned at said center of said enclosed housing; and three pairs of collinear accelerometers $a_1$–$a_2$; $a_3$–$a_4$; and $a_5$–$a_6$ respectively arranged along said x, y and z axes within said housing and with each pair being oppositely positioned relative to said center of said housing and separated from each other by a predetermined distance l, each of said accelerometers having an operating wavelength λ which is greater than said distance l.

2. The underwater acoustic receiver sensor according to claim 1, wherein said pressure sensor provides an output $P_0$ and each of said accelerometers provides an output signal respectively termed $a_1$, $a_2$, $a_3$, $a_4$, $a_5$, and $a_6$ and further comprising a means for combining said output signals to produce acceleration quantities $a_x$, $a_y$ and $a_z$ and acceleration gradients $$\frac{\partial a_x}{\partial x}, \frac{\partial a_y}{\partial y}, \text{ and } \frac{\partial a_z}{\partial z}$$

expressed as follows:

$$a_x = \frac{a_1 + a_2}{2}$$

-continued $$a_y = \frac{a_3 + a_4}{2};$$

$$a_z = \frac{a_5 + a_6}{2};$$

$$\frac{\partial a_x}{\partial x} \cong \frac{a_2 - a_1}{l}$$

$$\frac{\partial a_y}{\partial y} \cong \frac{a_4 - a_3}{l}; \text{ and}$$

$$\frac{\partial a_z}{\partial z} \cong \frac{a_6 - a_5}{l}.$$

3. The underwater acoustic receiver sensor according to claim 2 further comprising a computation means to produce the power sum ($B^7$) of weighted quantities expressed as follows:

$$B^7(\theta,\phi)=|w_p+w_x a+w_y b+w_z c+w'_x a^2+w'_y b^2+w'_z c^2|^2$$

where θ is the azimuth planewave arrival angle, φ is the elevation acoustic planewave arrival angle, and the directional responses are: a=cos(θ)sin(φ), b=sin(θ)sin(φ), and c=cos(φ) and the arbitrary weights are $w_p$, $w_z$, $w_y$, $w_z$, $w'_x$, $w'_y$, and $w'_z$.

4. The underwater acoustic receiver sensor according to claim 2, further comprising means for manipulating said acceleration quantities to produce a spatial gradient of velocity that is approximated by taking finite differences of the acceleration quantities so that (1) the acceleration gradient along the x-axis is $$\frac{\Delta a_x}{\Delta x} = \frac{a_2 - a_1}{l};$$

(2) the u-velocity gradient, $$\frac{\partial u}{\partial x},$$

is obtained by taking the time derivative of the acceleration gradient which, for harmonic planewaves, is accomplished by dividing the acceleration $a_x$ by a constant and multiplying by angular frequency; (3) the spatial gradient, $$\frac{\partial v}{\partial y},$$

is obtained by taking the time derivative of $a_y$ which, for harmonic planewave, is accomplished by dividing the acceleration $a_y$ by a constant and multiplying by angular frequency and (4) the spatial gradient, $$\frac{\partial w}{\partial z},$$

is obtained by taking the time derivative of $a_z$ which, for harmonic planewaves, is accomplished by dividing the acceleration $a_z$ by a constant and multiplying by angular frequency.

5. The underwater acoustic receiver sensor according to claim 3, having a directivity index of about 9.5 dB.

6. The underwater acoustic receiver sensor according to claim 1, wherein said operating wavelength $\lambda$ is representative of a frequency from 100 Hz to 2000 Hz.

7. The underwater acoustic receiver sensor according to claim 1, wherein resilient material is a polymer.

8. The underwater acoustic receiver sensor according to claim 7, wherein said polymer is polyurethane.

9. The underwater acoustic receiver sensor according to claim 1, wherein said pressure sensor is a piezoelectric ceramic hydrophone.

10. The underwater acoustic receiver sensor according to claim 1, wherein said resilient material has an acoustic impedance chosen to match that of water.

11. The underwater acoustic receiver sensor according to claim 1, wherein said sensor is neutrally buoyant.

* * * * *